US006047440A

United States Patent [19]

Jensen et al.

[11] Patent Number: 6,047,440

[45] Date of Patent: Apr. 11, 2000

[54] NON-ROTATING PINION CAP

[75] Inventors: James E. Jensen, Princeton; Andy Current, Oglesby, both of Ill.

[73] Assignee: Schlage Lock Company, San Francisco, Calif.

[21] Appl. No.: 09/192,696

[22] Filed: Nov. 16, 1998

[51] Int. Cl.[7] ..... E05F 1/00

[52] U.S. Cl. ..... 16/79; 16/62; 16/69; 16/64

[58] Field of Search ..... 16/49, 51, 62, 16/64, 69, 79, 56, 55

[56] References Cited

U.S. PATENT DOCUMENTS

| | | | |
|---|---|---|---|
| 611,285 | 9/1898 | Scheid | 16/69 |
| 2,994,906 | 8/1961 | Check | 16/51 |
| 3,546,734 | 12/1970 | Pollack et al. | 16/62 |
| 3,852,846 | 12/1974 | Slaybaugh | 16/51 |

FOREIGN PATENT DOCUMENTS

| | | | |
|---|---|---|---|
| 106180 | 1/1939 | Australia | 16/62 |

*Primary Examiner*—Chuck Y. Mah
*Assistant Examiner*—Donald M. Gurley
*Attorney, Agent, or Firm*—Michael H. Minns

[57] ABSTRACT

A non-rotatable pinion cap for use on a non-handed door closer where both ends of the drive pinion extend beyond the cylinder body. The pinion cap has one exposed edge for engaging the door or door frame surface and includes a christmas tree plug for attaching the pinion cap to a threaded hole in one end of the drive pinion. The plug can either be free to rotate with the pinion or it can be fixed to the cap. The slippage of the plug permits the drive pinion to rotate while the pinion cap does not rotate.

16 Claims, 2 Drawing Sheets

NON-ROTATING PINION CAP

BACKGROUND OF THE INVENTION

This invention relates generally to pinion caps for use with a door closer and more particularly to a non-rotatable pinion cap.

State of the art door closers are non-handed. In order to make a door closer non-handed, the drive pinion must extend outside of the cylinder body on both sides. Most drive pinions have a threaded hole in both ends of the pinion. On one end, a threaded fastener, inserted into the end of the pinion, secures the arm linkage to the pinion. For aesthetic reasons, the other pinion end is often covered with a pinion cap. A typical prior art pinion cap is shown in FIG. 1.

These pinion caps are typically attached in one of two ways: to the closer body or rotationally attached to the pinion. There are limitations and drawbacks to each design.

The foregoing illustrates limitations known to exist in present door closer pinion caps. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a door closer having a cylinder body with a rotatable pinion therein, both ends of the drive pinion extending exteriorly of the cylinder body; and a removable pinion cap comprising: a cover; an attachment means for attaching the cover to the drive pinion; and a slip means for permitting the drive pinion to rotate relative to the cover.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION

Figure 1:
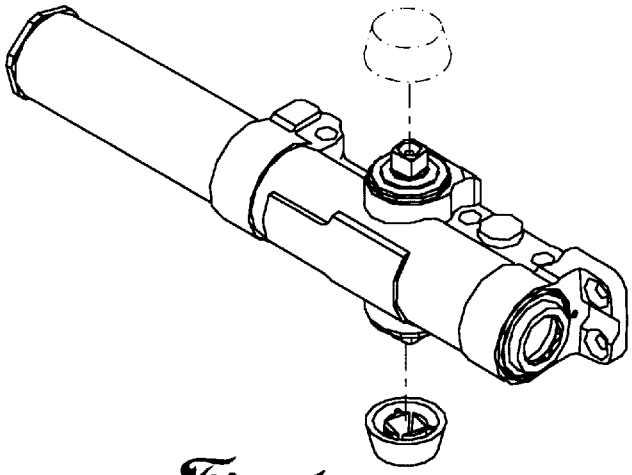
Fig. 1 Prior Art
FIG. 1 is an exploded perspective view of a door closer with a prior art pinion cap.
Figure 2:
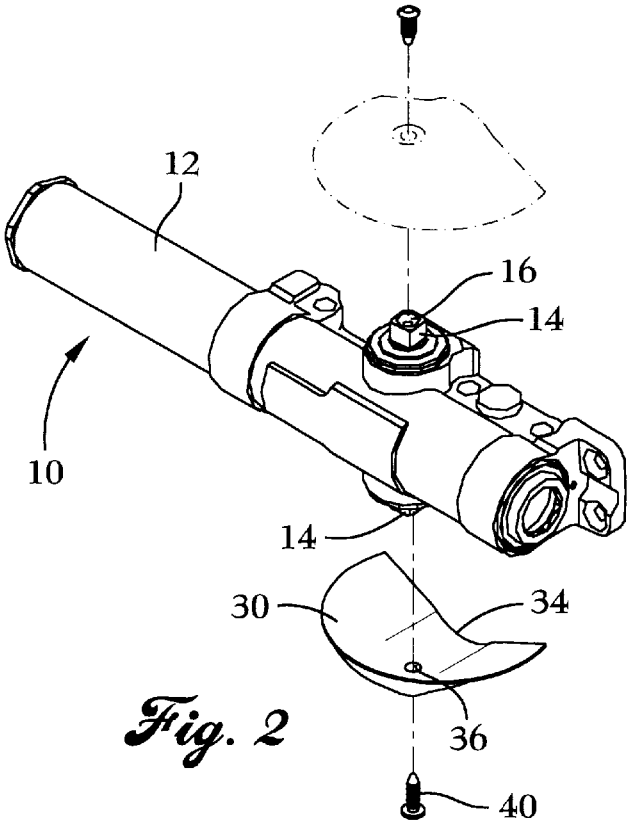
FIG. 2 is an exploded perspective of a first embodiment of a non-rotating pinion cap according to the present invention.
Figure 3:
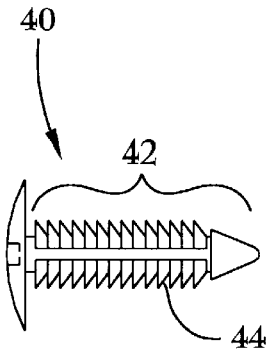
FIG. 3 is a side view of the christmas tree plug shown in FIG. 2.

FIG. 2 shows a door closer 10 with a cylinder body 12 where the rotating drive pinion 14 extends from both sides of the cylinder body 12. Typically, each end of the drive pinion 14 contains a threaded hole 16. The pinion cap of the present invention consists of a pinion cap cover 30 with a means 40 for attaching the pinion cap cover 30 to the drive pinion threaded hole 16. The preferred means 40 is a plug with a christmas tree stud end 42, shown in FIG. 3. The "finning" 44 on the christmas tree stud end extends, in an interrupted manner, around the plug 40. The plug 40 is attached to the pinion cover cap 30 by pressing through a hole 36 in the pinion cap cover 30. The plug 40 is then pressed or threaded into the threaded hole 16 in the end of the drive pinion 14. The plug 40 can either be free to rotate with the drive pinion 14 or it can be non-rotatably fixed to the pinion cover cap 30.

The pinion cap cover 30 has one door surface engaging edge 34. This edge 34 engages the surface of either the door or door frame (depending upon to which surface the door closer 10 has been installed). This door surface engaging edge 34 in combination with a slip means for permitting the drive pinion 14 to rotate relative to the pinion cap cover 30 holds the pinion cap cover 30 stationary while the drive pinion 14 is rotating. In the embodiment shown in FIG. 2, the slip means permits the plug 40 to rotate relative to the pinion cap cover 30. In an alternate embodiment, not shown, the slip means could permit the drive pinion 14 to rotate relative to the plug 40, the plug 40 being non-rotatably fixed to the pinion cap cover 30.

Figure 4:
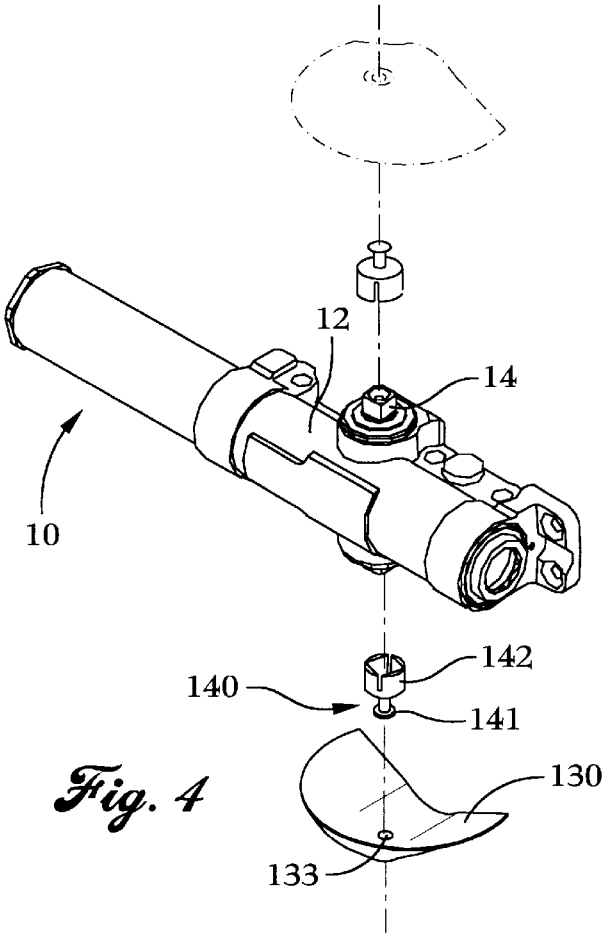
FIG. 4 is an exploded perspective of a second embodiment of a non-rotating pinion cap according to the present invention.

In the alternate embodiment shown in FIG. 4, the pinion cap cover 130 is attached to a square pinion attachment means 142 by slip connector 140. In this embodiment, the slip means, or slip connector, 140 permits the square pinion attachment means 142 to rotate relative to the pinion cap cover 130, the square pinion attachment means 142 being non-rotatably fixed to the drive pinion.

In the preferred embodiment of the alternate embodiment shown in FIG. 4, the slip connector 140 comprises a knob 141 on the square pinion attachment means 142 which fits into a hole 133 in the pinion cap cover 130 with a slip fit between the knob 141 and the pinion cap cover 130.

Having described the invention, what is claimed is:

1. In combination:

a door closer having a cylinder body with a rotatable pinion therein, both ends of the drive pinion extending exteriorly of the cylinder body; and a removable pinion cap comprising: a cover; an attachment means for attaching the cover to the drive pinion; and a slip means for permitting the drive pinion to rotate relative to the cover.

2. The combination according to claim 1, wherein the drive pinion has a threaded hole in each end thereof.

3. The combination according to claim 2, wherein the attachment means is a plug having a christmas tree stud end, the christmas tree stud end engaging the drive pinion threaded hole.

4. The combination according to claim 1, wherein the attachment means rotates relative to the cover.

5. The combination according to claim 1, wherein the drive pinion rotates relative to the attachment means.

6. The combination according to claim 1, wherein the slip means permits the drive pinion to rotate relative to the attachment means.

7. The combination according to claim 1, wherein the slip means permits the attachment means to rotate relative to the cover.

8. The combination according to claim 1, wherein the pinion cap has a surface engaging edge adapted to engage one of a door or a door frame.

9. In combination:

a door closer having a cylinder body with a rotatable pinion therein, both ends of the drive pinion extending exteriorly of the cylinder body, the drive pinion having a threaded hole in each end thereof; and a removable pinion cap comprising: a cover; an attachment means for attaching the cover to the drive pinion, the attachment means being a plug having a christmas tree stud end, the christmas tree stud end engaging the drive pinion threaded hole; and a slip means for permitting the drive pinion to rotate relative to the cover.

10. The combination according to claim 9, wherein the drive pinion rotates relative to the attachment means.

11. The combination according to claim 9, wherein the slip means permits the drive pinion to rotate relative to the attachment means.

12. A door closer having a cylinder body with a rotatable pinion therein, both ends of the drive pinion extending exteriorly of the cylinder body, the drive pinion having a threaded hole in each end thereof; and a pinion cap comprising: a cover and an attachment means for attaching the cover to the drive pinion, wherein the improvement comprises a slip means for permitting the drive pinion to rotate relative to the cover.

13. The door closer according to claim 12, wherein the attachment means is a plug having a christmas tree stud end, the christmas tree stud end engaging the drive pinion threaded hole.

14. The door closer according to claim 12, wherein the slip means permits the drive pinion to rotate relative to the attachment means.

15. The door closer according to claim 12, wherein the slip means permits the attachment means to rotate relative to the cover.

16. The door closer according to claim 12, wherein the improvement further comprises wherein the pinion cap having a surface engaging edge adapted to engage one of a door or a door frame.

* * * * *